US009908738B1

(12) United States Patent
Tóth

(10) Patent No.: US 9,908,738 B1
(45) Date of Patent: Mar. 6, 2018

(54) CABLE DISPENSER

(76) Inventor: Csaba Tóth, Brooklyn, NY (US)

( * ) Notice: Subject to any disclaimer, the term of this patent is extended or adjusted under 35 U.S.C. 154(b) by 777 days.

(21) Appl. No.: 13/530,223

(22) Filed: Jun. 22, 2012

(51) Int. Cl.
*B65H 49/30* (2006.01)
*B21C 47/34* (2006.01)

(52) U.S. Cl.
CPC ..... *B65H 49/305* (2013.01); *B65H 49/30* (2013.01); *B21C 47/34* (2013.01)

(58) Field of Classification Search
CPC ..... B65H 49/305; B65H 49/30; B65H 75/24; B21C 47/34
USPC ..... 242/401, 404.3, 406, 407.1, 604, 607, 242/607.1, 577–577.4, 597.7
See application file for complete search history.

(56) References Cited

U.S. PATENT DOCUMENTS 481,306 A * 8/1892 Miller ..... 242/422.9
483,830 A * 10/1892 Buchanan ..... 242/574.4
502,373 A * 8/1893 Munslow ..... 242/577.4
718,194 A * 1/1903 Delphey ..... 242/577
732,835 A * 7/1903 Delphey ..... 242/577
824,290 A * 6/1906 Eichhoff ..... 242/396.5
941,637 A * 11/1909 Jameson ..... 33/754
1,017,936 A * 2/1912 Welty ..... 242/407.1
1,191,904 A * 7/1916 Luick ..... 242/574.4
1,261,738 A * 4/1918 Palmer ..... 242/577.3
1,262,446 A * 4/1918 Caron ..... 242/577.4
1,354,565 A * 10/1920 James ..... 242/577.4
1,444,154 A * 2/1923 Jenks ..... 242/407.1
1,539,016 A * 5/1925 Mizuno ..... 242/577.2
1,831,848 A * 11/1931 Doney et al. ..... 242/574
1,836,969 A * 12/1931 Hick ..... 242/578
1,950,492 A 3/1934 Holmes, Jr.
2,064,886 A * 12/1936 Charlesworth ..... 242/577.4
2,267,071 A * 12/1941 Becker ..... 242/577.4
2,300,869 A * 11/1942 Brandes, Jr. ..... 242/575.5
2,370,868 A * 3/1945 Luebke ..... 242/407.1
2,476,176 A * 7/1949 Blanton ..... 242/575.5
2,517,723 A * 8/1950 Schoditsch ..... 242/577.3
2,557,510 A 6/1951 Nau-Touron
2,676,768 A * 4/1954 Wynn ..... 242/577.4
2,707,599 A * 5/1955 Snyder ..... 242/407.1
2,819,760 A * 1/1958 Norehad ..... 242/487.6
2,866,606 A * 12/1958 Westfall et al. ..... 242/574
2,936,133 A * 5/1960 Casey et al. ..... 242/577.4
2,946,535 A * 7/1960 Marion ..... 242/597.3
3,072,358 A * 1/1963 Knapp ..... 242/129
3,160,362 A 12/1964 Weber
3,203,637 A * 8/1965 Kaiser et al. ..... 242/571
3,302,902 A * 2/1967 Brinkman ..... 242/576.1
3,326,495 A * 6/1967 De Bruyn ..... 242/577
3,584,809 A * 6/1971 Ogden, Sr. ..... 242/129
3,731,886 A * 5/1973 Macchi ..... 242/602

(Continued)

*Primary Examiner* — Michael E Gallion
(74) *Attorney, Agent, or Firm* — Robert C Montgomery; Montgomery Patent & Design LP

(57) ABSTRACT

A cable dispenser which aids in transporting, storing, and deploying coiled or spooled wire is disclosed. The cable dispenser includes a base with a rotating circular top plate which has adjustable guide posts that laterally stabilize a spool of wire. The cable dispenser further includes a center post with a top-mounted handle for carrying or suspending the dispenser from a hook-like appendage. The guide posts may be removed to allow use with spooled wire by placing the spooled wire on the center rod. The base includes a bearing which enables rotation of the top plate and the wire.

13 Claims, 5 Drawing Sheets

(56) References Cited

U.S. PATENT DOCUMENTS

| | | | | | |
|---|---|---|---|---|---|
| 3,815,842 | A * | 6/1974 | Scrogin | 242/423.1 |
| 3,837,597 | A * | 9/1974 | Bourhenne | 242/129 |
| 4,143,826 | A * | 3/1979 | Lamperti | 242/564.4 |
| 5,025,999 | A * | 6/1991 | Littrell | 242/577 |
| RE34,376 | E * | 9/1993 | Branback | 242/129 |
| 5,276,594 | A | 1/1994 | Burkett et al. | |
| 5,348,241 | A * | 9/1994 | Huette | 242/597.5 |
| 5,704,564 | A * | 1/1998 | Neiderman | 242/527.5 |
| 6,267,319 | B1 * | 7/2001 | Hoffmann et al. | 242/532.6 |
| 6,533,205 | B1 | 3/2003 | Kles | |
| 6,554,217 | B1 | 4/2003 | Rodriguez | |
| 6,655,627 | B2 * | 12/2003 | Patton | 242/397.2 |
| 7,080,802 | B2 * | 7/2006 | Bayer et al. | 242/423.1 |
| 7,918,414 | B1 * | 4/2011 | Davis et al. | 242/588 |
| 2001/0035473 | A1 * | 11/2001 | Patton | 242/397.2 |
| 2005/0045759 | A1 * | 3/2005 | Hibbs | 242/588.2 |
| 2005/0116083 | A1 * | 6/2005 | Bayer et al. | 242/597.7 |
| 2005/0253015 | A1 * | 11/2005 | Bohnisch | 242/578 |
| 2010/0001116 | A1 * | 1/2010 | Johnson | 242/588 |
| 2011/0198430 | A1 * | 8/2011 | Rothell | 242/401 |

* cited by examiner

CABLE DISPENSER

RELATED APPLICATIONS

There are currently no applications co-pending with the present application.

FIELD OF THE INVENTION

The presently disclosed subject matter is directed to devices for dispensing wire and cable. More particularly, the present invention relates to a cable dispenser for transporting, storing, and deploying coiled or spooled wire.

BACKGROUND OF THE INVENTION

Anyone who performs a lot of physical work will attest that having the right tool is critical to doing a workman-like job. Having the proper tool can save time, money, and effort, result in a better quality job, reduce equipment damage, and increase worker safety and enjoyment.

Different fields of work tend to have rather specialized tools for performing specialized tasks. In the electrical field one common task is pulling wires or cable through conduits or cable trays. Known in the prior art are large reel pulling systems that are highly effective on large jobs. Unfortunately they are rather difficult to move around, and as they tend to have open designs it easy for dirt, dust and other construction site contamination to accumulate on the wire and cable. On smaller jobs electricians often just clamp screwdrivers to chairs, buckets, or any other handy objects. So long as the clamp holds, this approach can be effective. But, over time clamps tend to fall off, which can lead to wasted time, effort, damage to surrounding equipment, and safety hazards.

Accordingly, there is a need for devices by which cable and wire can be stored, transported, and pulled in a manner without using clamps. Ideally such a device could be used on the ground, on the floor, or held in a hand. Even more useful would be such a device that is small, highly portable, rugged, and takes up little space. Preferably such a device would enable quick and easy changing of wires and cables.

SUMMARY OF THE INVENTION

The principles of the present invention provide for devices that aid in transporting, storing, and deploying wire. A cable dispenser that is in accord with the principles of the present invention includes a top plate having a bottom and a top surface that receives wire to be dispensed. The top plate also includes a first radial guide post slot, a second radial guide post slot, and a center aperture. The top plate rotates on a base frame by the action of a central bearing. The central bearing includes a rotating upper flanged top that is attached to the bottom of the top plate and a lower base that is attached to the base frame. This mounting enables the top plate to rotate relative to the base frame. To maintain wire being dispensed in position, the cable dispenser further includes a first adjustable guide post and a second adjustable guide post that respectively protrude upward from the first radial guide post slot and the second radial guide post slot, while a center guide post protrudes upward from the center aperture. To retain wire in position the first adjustable guide post and the second adjustable guide post are firmly attached in position relative to the top plate.

Beneficially, there are a plurality of feet attached to the base frame and the top plate and base frame are comprised of light-weight, strong materials.

The guide posts are preferably retained in position using first and second channel brackets that are attached to the top plate to form first and second elongated channels which are respectively aligned with the first and second radial guide post slots. In addition, the first and second guide posts respectively include first and second guide post threaded members and first and second guide post collars. The cable dispenser further includes first and second nuts that are respectively captured in the first and second elongated channels. The first and second guide post threaded members respectively screw into the first and second nuts.

Preferably the center guide includes a ring post and a mating "D" ring. Additionally, the center aperture is thread, and the center guide post has a bottom center guide post threaded member and a center guide post collar. To attach the center guide post to the top plate the center guide post threaded member screws into the center aperture.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
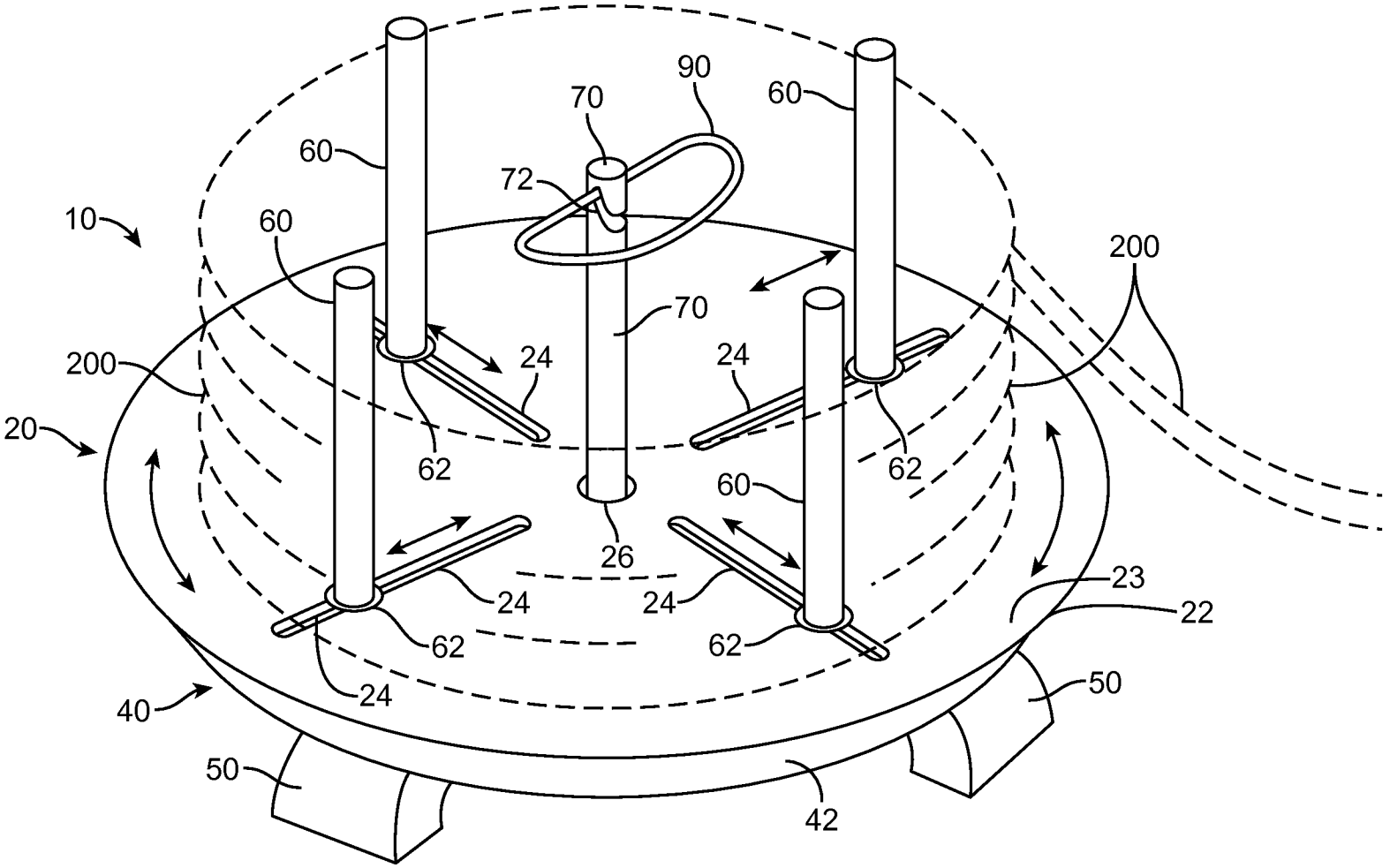
FIG. 1 is a perspective view of a cable dispenser 10 according to a preferred embodiment of the present invention.

10 cable dispenser
20 top plate assembly
22 top plate
23 top surface
24 guide post slot
26 center post aperture
30 nut fastener
32 threaded aperture
34 channel bracket
35 elongated channel
40 base assembly
42 base frame
44 bearing assembly
46 center post aperture
48 fastener aperture
50 foot
60 wire guide post
62 guide post collar
64 guide post male fastener
70 center post
72 ring slot
74 center post collar
76 center post male fastener
90 D-ring fastener
200 coiled wire
210 spooled wire

DETAILED DESCRIPTION OF THE PREFERRED EMBODIMENT

The best mode for carrying out the invention is presented in terms of its preferred embodiment, herein depicted within FIGS. 1 through 4*b*, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 2:
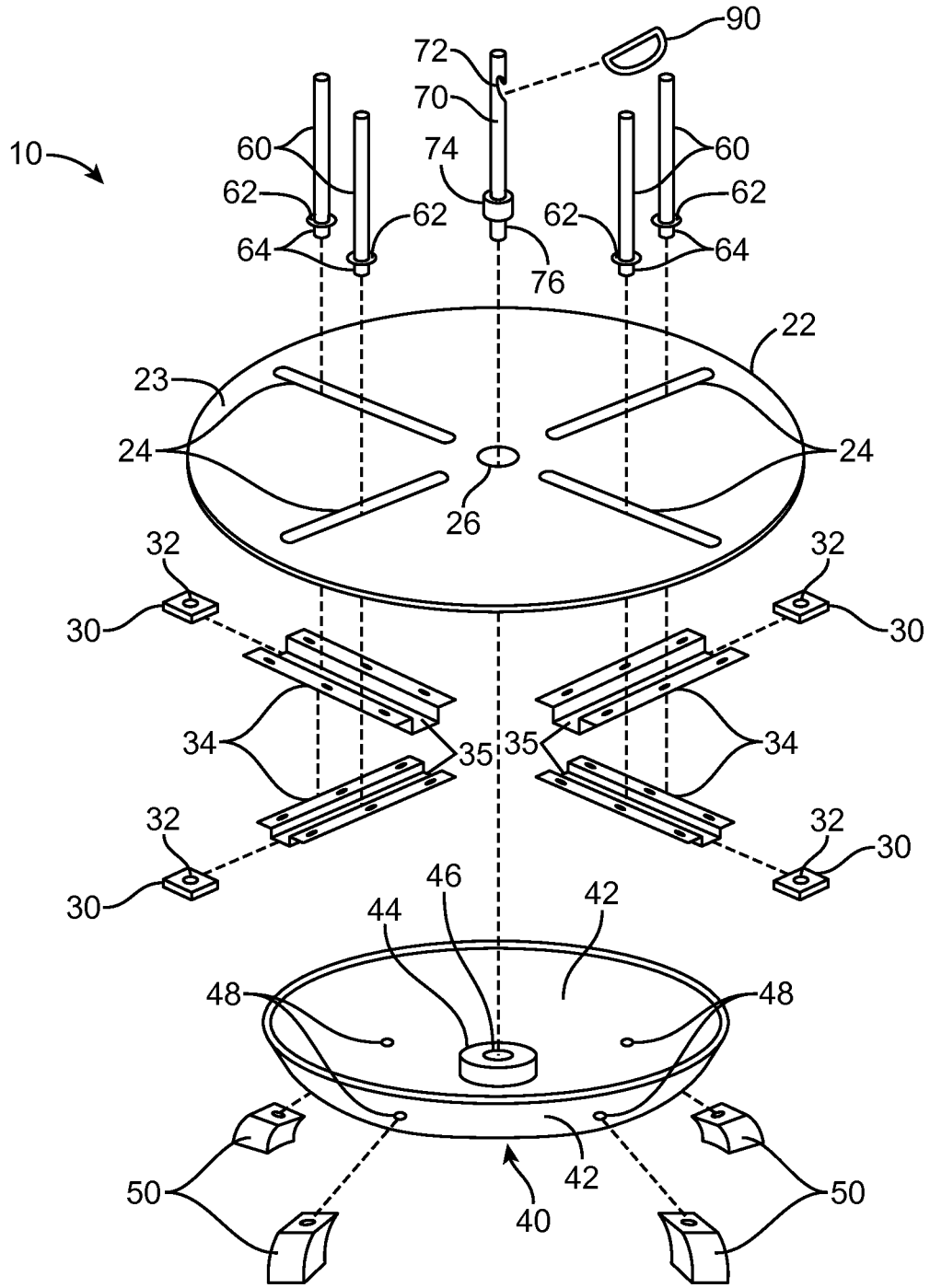
FIG. 2 is an exploded view of the cable dispenser 10 shown in FIG. 1.
Figure 3:
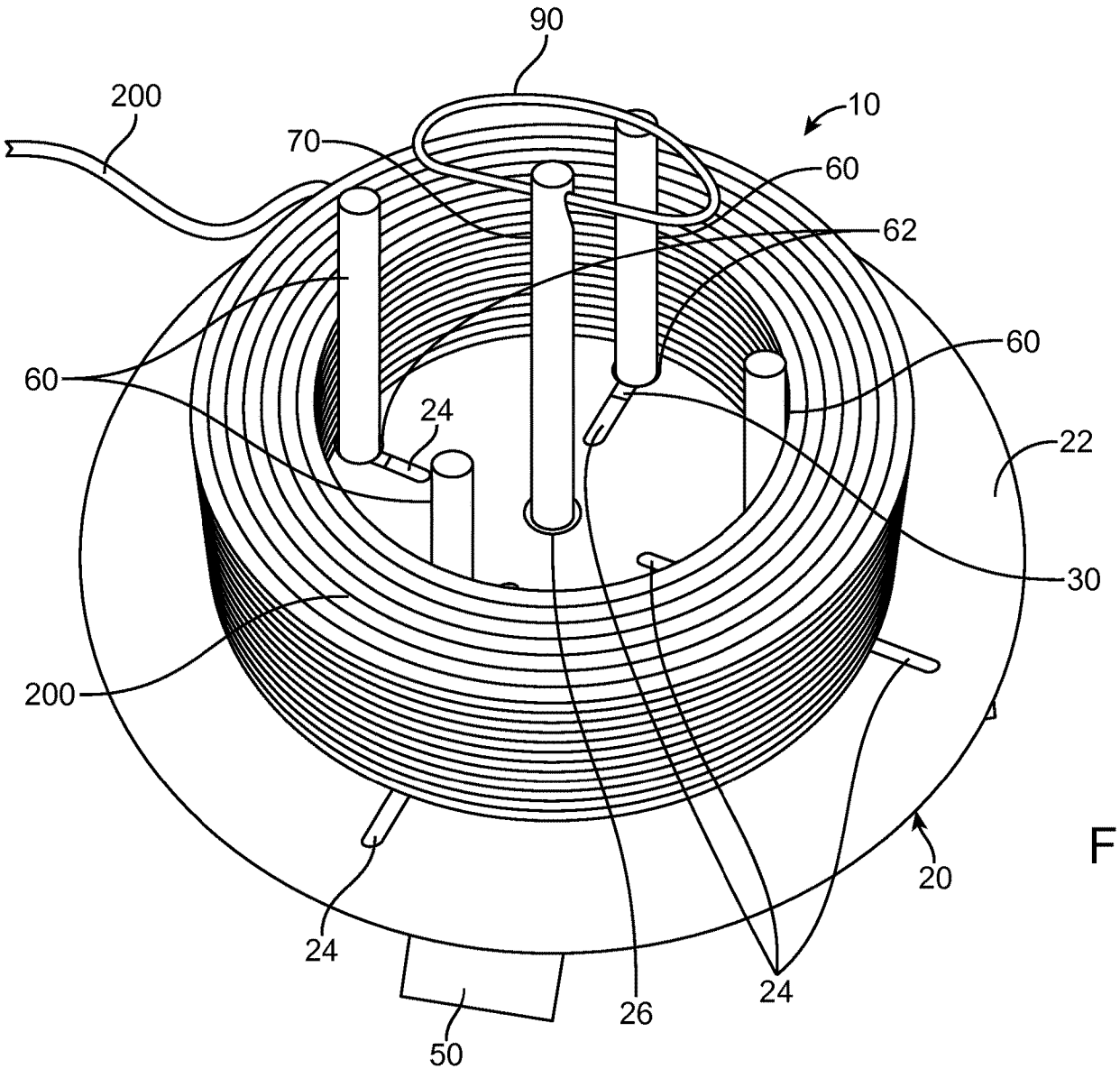
FIG. 3 is a perspective view of the cable dispenser 10 in use holding coiled wire 200.
Figure 4A:
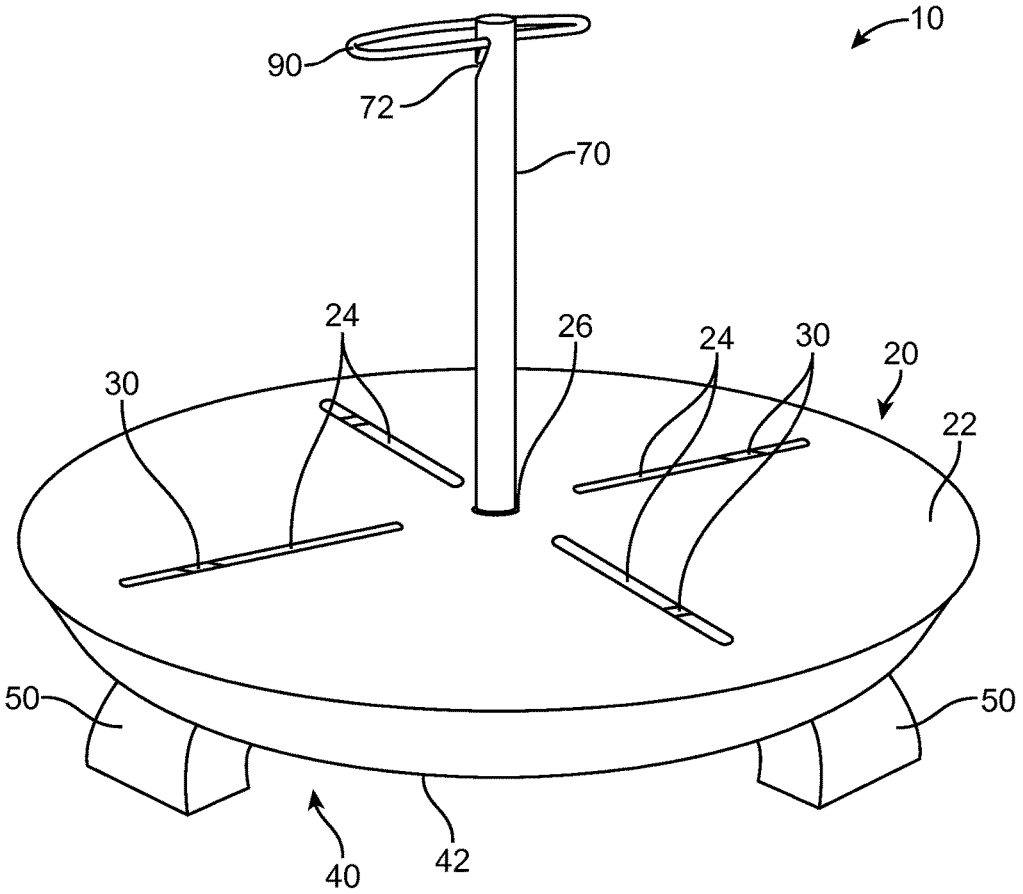
FIG. 4*a* is a perspective view of the cable dispenser 10 configured for use with spooled wire 210; and, FIG. 4*b* is a perspective view of the cable dispenser 10 in use holding spooled wire 210.
Figure 4B:
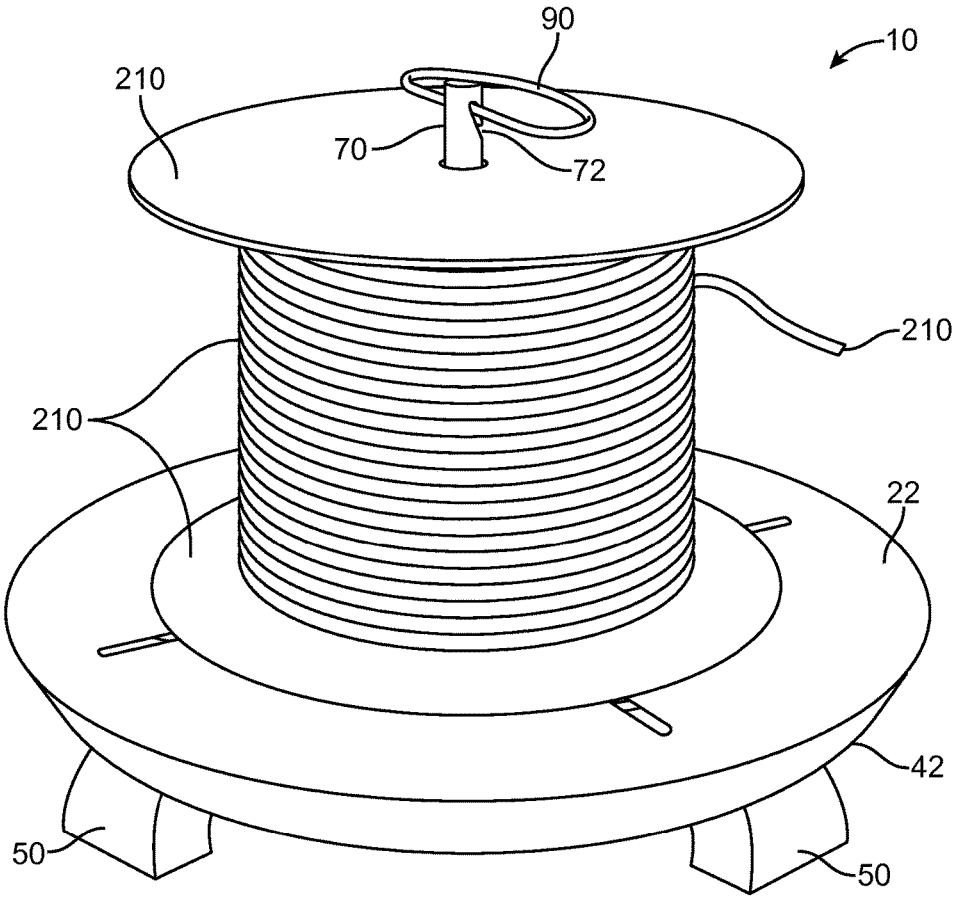

The present invention enables transporting, storing, and deploying cables or electrical wire (such as the electrical wire 200, 210, shown respectively in FIGS. 3 and 4*b*). Turning now to FIG. 1, an inventive cable dispenser 10 has a rotating circular top plate 22 having a top surface 23 onto which coiled wire 200 or spooled wire 210 can be positioned for dispensing. The top plate 22 can support a plurality of upwardly protruding and adjustable guide posts 60 and/or a center post 70. Those posts 60, 70 act to retain wire 200, 210 in a stable but rotatable position. A base assembly 40 supports the top plate 22 via a central bearing assembly 44 (see FIG. 2) and a base frame 42, thereby allowing the top plate 22 and the wiring 200, 210 to freely rotate during dispensing of the wire 200, 210. The cable dispenser 10 can be placed on a floor, the ground, held in a user's hand, or hung from an appendage as required.

In use, the cable dispenser 10 provides electricians, cable installers, telephone technicians and others who work with wire and/or cable the ability to quickly and easily store, transport, and pull wire and cable. In practice, the top plate 22 is envisioned as being introduced in a variety of sizes between approximately ten to twenty inches (10-20 in.) in diameter, based upon the electrical and wiring tasks to be performed. Furthermore said top plate assembly 20 and base plate assembly 40 are envisioned to be made of rugged light-weight materials such as aluminum, compound plastic compositions, and the like.

Refer now to FIGS. 1 and 2, perspective and exploded views of the cable dispenser 10. The cable dispenser 10 includes a flat circular top plate assembly 20 which includes the flat circular top plate 22 having the top surface 23, the four (4) wire guide posts 60, and the center post 70. The top plate assembly 20 rotates on and is supported by the bearing assembly 44. The bearing assembly 44 is envisioned as a ball-bearing or roller-bearing having an upper flanged rotating top surface and a lower stationary base. The flanged top surface is fastened to the bottom of the top plate 22 by welding, brazing, soldering, or by common fasteners, while the stationary base is similarly fastened to the top of the bowl-shaped base frame 42. The attachment of the bearing assembly 44 to the top plate 22 allows smooth rotation of the top plate assembly 20 when it is loaded with and dispensing wire 200, 210.

The top plate assembly 20 enables adjusting the positions of the four (4) wire guide posts 60 along respective guide post slots 24. The guide post slots 24 are machined or otherwise formed slots formed through the top plate 22 so as to radiate outward from near the center of the top plate 22 to near the perimeter of the top plate 22. Each guide post slot 24 enables threaded attachment of a wire guide post 60. The wire guide posts 60 are useful for centering coiled wire 200 on the cable dispenser 10. Each guide post 60 is a rod-shaped member having an integral washer-shaped guide post collar 62 and a threaded guide post male fastener 64 at its bottom.

Each guide post slot 24 works in conjunction with a subjacent channel bracket 34 having a nut fastener 30 with a female threaded aperture 32 that is captured in an elongated channel 35. Each channel bracket 34 is mounted to the bottom of the top plate 22 by welding, brazing or by using common fasteners such as screws so as to be centered along a respective guide post slot 24. Each channel bracket 34 forms a central rectangular channel 35 that is dimensioned to receive and capture a sliding square or hexagon nut fastener 30 such that the fastener 30 can move along the channel 35 but not turn. The nut fasteners 30 have female threaded apertures 32 that receive the aforementioned guide post male fasteners 64. Tightening a guide post male fastener 64 into a female threaded aperture 32 firmly attaches the wire guide post 60 to the top plate 22. When all wire guide posts 60 are firmly tightened the wire guide posts 60 and the nut fasteners 30 are firmly held in place and retain the wire 200 on the top plate 22 in position.

Spooled wire 210 may also be mounted on the top plate 22 and dispensed. To do so the wire guide posts 60 are removed and the center post 70 is attached to the top plate to act as a central vertical axle for the spooled wire 210. The center aperture of the spooled wire 210 (see FIG. 4*b*) is then placed on the center post 70.

The center post 70 is connected to the top plate assembly 22 using the subjacent bearing assembly 44 that is part of the base assembly 40. To that end the center post 70 has an integral center post collar 74 and a center post male fastener 76 at its bottom. The center post male fastener 76 is inserted through a center post aperture 26 in the top plate 22 and into a female threaded center post aperture 46 in the bearing assembly 44. The center post male fastener 76 is then screwed into the female threaded center post aperture 46 until the center post collar 74 forms a mechanical limitation with the top plate assembly 22. Tightening the center post 70 holds the center post 70 firmly in position to receive the center aperture of the spooled wire 210.

Referring now to FIG. 2, the base assembly 40 includes the bowl-shaped base frame 42 which provides a stable support for the top plate 22 and wire 200, 210. To that end the base assembly 40 beneficially has a diameter similar to that of the top plate 22. The base assembly 40 further comprises four (4) feet 50 that are arranged and mounted along the bottom of the base frame 42 using drilled or formed fastener apertures 48. The feet 50 stabilize the cable dispenser 10 when it is placed on a flat surface. The cable dispenser 10 may also be carried or suspended by a user via a removably attached D-ring fastener 90 inserted into an integral ring slot 72 located at an upper end of the center post 70. The ring slot 72 is preferably dimensioned to receive that D-ring fastener 90 using an interference friction fit.

Refer now to FIG. 3, a perspective view of the cable dispenser 10 in use with coiled wire 200. As shown, a considerable length of coiled wire 200 can be mounted and centered on the top plate 22 using the wire guide posts 60. After placing the coiled wire 200 on the top plate 22 the wire guide posts 60 are adjusted to abut the coiled wire 200. The wire guide posts 60 are then secured in position by threading and tightening the center post male fastener portions 76 into respective subjacent nut fasteners 30 under the guide post slots 24 (see FIG. 2).

Refer now to FIGS. 4*a* and 4*b*, perspective views of the cable dispenser 10 depicting use with spooled wire 210. The cable dispenser 10 is shown after removal of the wire guide posts 60. This enables the cable dispenser 10 to receive spooled wire 210. The cable dispenser 10 comprises a D-ring fastener 90 that is removably attached using the ring slot 72 of the center post 70. The D-ring fastener 90 is envisioned as being particularly useful after spooled wire 210 is loaded onto the cable dispenser 10 because it mechanically secures the spooled wire 210 on the center post 70. The D-ring fastener 90 may be fastened to a superjacent appendage such as a hook, wire, or other supporting feature to suspend the cable dispenser 10 and the spooled wire 210.

It is envisioned that other styles and configurations of the present invention can be easily incorporated into the teachings of the present invention; while only one particular embodiment is shown and described that is for purposes of clarity and disclosure and not by way of limitation of scope.

The preferred embodiment of the present invention can be utilized by the common user in a simple and effortless manner with little or no training. After initial purchase or acquisition of the cable dispenser 10, it would be installed and utilized as indicated in FIGS. 1, 3, and 4*b*.

The method of configuring and using the cable dispenser 10 with coiled wire 200 may be achieved by performing the following steps: procuring a model of the cable dispenser 10 having a desired overall diameter; loading a quantity of coiled wire 200 onto the cable dispenser 10 by loosening the wire guide posts 60 from their subjacent nut fasteners 30; sliding the wire guide posts 60 inwardly toward the center of the top plate 22; placing the coiled wire 20 on the top plate 22; sliding the wire guide posts 60 outwardly against inner surfaces of the coiled wire 200; securing the wire guide posts 60 in position by tightening them into their respective nut fasteners 30; placing the cable dispenser 10 upon a flat surface such as a floor; allowing the top plate 22 with its coiled wire 200 to rotate freely upon the base assembly 40 while dispensing the coiled wire 200; replenishing the coiled wire 200 as needed, by repeating the steps described above; and, benefiting from a stable and efficient means to dispense coiled wire 200 afforded a user of the cable dispenser 10.

The cable dispenser 10 may be alternately suspended from a hook, wire, or similar supporting appendage to position the cable dispenser 10 at a desired height by installing the D-ring fastener 90 into the ring slot portion 72 of the center post 70 and then attaching the D-ring fastener 90 to the superjacent appendage, based on a particular electrical wiring project.

The method of configuring and utilizing the cable dispenser 10 for use with spooled wire 210 may be achieved by performing the following steps: removing the wire guide posts 60 from the top plate 22 by disengaging the guide post male fastener 64 of the wire guide posts 60 from the subjacent nut fasteners 30; removing the D-ring fastener 90 from the center post 70; inserting a center aperture of a spooled wire 210 over the center post 70 to rest on the top plate 22; reinstalling the D-ring fastener 90 onto the center post 70 to help retain the spooled wire 210 on the center post 70; placing the cable dispenser 10 on a floor or suspending the cable dispenser 10 from a superjacent appendage using the D-ring fastener 90; dispensing spooled wire 210; replenishing the spooled wire 210 as needed by removing the D-ring fastener 90; removing the spent spool of spooled wire 210; installing fresh spooled wire 210 on the center post 70; securing the spooled wire 210 on the center post 70 by reinstalling the D-ring fastener 90; and, completing the electrical wiring project in a quick and efficient manner using the cable dispenser 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A cable dispenser, comprising:

a top plate having a bottom and a top surface for receiving wire, said top plate including a first radial guide post slot and a second radial guide post slot;

a base frame;

a central bearing attached to said base frame and having a rotating upper flanged top that is attached to said bottom such that said top plate can rotate relative to said base frame; and, a first adjustable guide post and a second adjustable guide post that respectively protruding upward from said first radial guide post slot and said second radial guide post slot;

wherein said first adjustable guide post and said second adjustable guide post are firmly attached in position relative to said top plate; a first channel bracket and a second channel bracket that are attached to said bottom to form a first elongated channel aligned with said first radial guide post slot and a second elongated channel aligned with said second radial guide post slot.

2. The cable dispenser according to claim 1, further including a plurality of feet attached to said base frame.

3. The cable dispenser according to claim 1, wherein said top plate and said base frame are comprised of light-weight materials.

4. The cable dispenser according to claim 1, wherein said first adjustable guide post includes a first guide post threaded member and a first guide post collar, wherein said second adjustable guide post includes a second guide post threaded member and a second guide post collar.

5. The cable dispenser according to claim 4, further including a first nut captured in said first elongated channel and a second nut captured in said second elongated channel;

wherein said first guide post threaded member screws into said first nut until said first guide post collar firmly contacts said top plate and wherein said second guide post threaded member screws into said second nut until said second guide post collar firmly contacts said top plate.

6. A cable dispenser, comprising:

a top plate having a bottom and a top surface for receiving wire, said top plate including a first radial guide post slot, a second radial guide post slot, and a center aperture;

a base frame;

a central bearing having a rotating upper flanged top attached to said bottom and a lower base attached to said base frame such that said top plate can rotate relative to said base frame;

a first adjustable guide post and a second adjustable guide post that respectively protruding upward from said first radial guide post slot and said second radial guide post slot; and, a center guide post protruding upward from said center aperture;

wherein said first adjustable guide post and said second adjustable guide post are firmly attached in position relative to said top plate; a first channel bracket and a second channel bracket that are attached to said bottom to form a first elongated channel aligned with said first radial guide post slot and a second elongated channel aligned with said second radial guide post slot.

7. The cable dispenser according to claim 6, further including a plurality of feet attached to said base frame.

8. The cable dispenser according to claim 6, wherein said top plate and said base frame are comprised of light-weight materials.

9. The cable dispenser according to claim 6, wherein said first adjustable guide post includes a first guide post threaded member and a first guide post collar, and wherein said second adjustable guide post includes a second guide post threaded member and a second guide post collar.

10. The cable dispenser according to claim 9, further including a first nut captured in said first elongated channel and a second nut captured in said second elongated channel;

wherein said first guide post threaded member screws into said first nut until said first guide post collar firmly contacts said top plate, and wherein said second guide post threaded member screws into said second nut until said second guide post collar firmly contacts said top plate.

11. The cable dispenser according to claim 6, wherein said center guide includes a ring post.

12. The cable dispenser according to claim 11, further includes a "D" ring attached to said ring post.

13. The cable dispenser according to claim 12, wherein said center guide post includes a center guide post threaded member and a center guide post collar, and wherein said center guide post screws into said center aperture until said guide post collar firmly contacts said top plate.

* * * * *